US006565251B2

(12) United States Patent
Chen

(10) Patent No.: US 6,565,251 B2
(45) Date of Patent: May 20, 2003

(54) TUBULAR DECORATION LIGHT STRING

(76) Inventor: Wen Tarng Chen, No. 504, Section 4, Chung-Hua Road, Hsin-Chu City (TW)

( * ) Notice: Subject to any disclaimer, the term of this patent is extended or adjusted under 35 U.S.C. 154(b) by 0 days.

(21) Appl. No.: 09/955,459

(22) Filed: Sep. 18, 2001

(65) Prior Publication Data

US 2002/0034074 A1 Mar. 21, 2002

(30) Foreign Application Priority Data

Sep. 18, 2000 (TW) ..... 00250299

(51) Int. Cl.[7] ..... F21S 4/00

(52) U.S. Cl. ..... 362/806; 362/236; 362/238; 362/311; 362/555

(58) Field of Search ..... 362/216, 227, 362/238, 239, 240, 249, 252, 555, 800, 806

(56) References Cited

U.S. PATENT DOCUMENTS

| | | | | | |
|---|---|---|---|---|---|
| 4,107,767 | A | * | 8/1978 | Anquetin | 362/236 |
| 4,271,458 | A | * | 6/1981 | George, Jr. | 362/236 |
| 4,665,470 | A | * | 5/1987 | George, Jr. | 362/236 |
| 4,727,459 | A | * | 2/1988 | Palumbo | 313/112 |
| 4,812,956 | A | * | 3/1989 | Chen | 362/236 |
| 5,934,792 | A | * | 8/1999 | Camarota | 362/240 |
| 6,406,166 | B1 | * | 6/2002 | Ko | 315/185 R |

* cited by examiner

*Primary Examiner*—Thomas M. Sember
*Assistant Examiner*—John Amarantides
(74) *Attorney, Agent, or Firm*—Bucknam and Archer

(57) ABSTRACT

A tubular decoration light string comprising inner insulator and outer insulator, said decoration light string equipped and fixed an inner insulator, said inner insulator and decoration light string to be sealed within an outer insulator, and to form a longitudinal direction hollow in said outer insulator, increasing an effect of reflection and refraction of light.

10 Claims, 5 Drawing Sheets

TUBULAR DECORATION LIGHT STRING

BACKGROUND OF THE INVENTION

The present invention generally relates to a tubular decoration light string comprising inner insulator and outer insulator, said the decoration light string equipped and fixed an inner insulator, said inner insulator and decoration light string to be seated within an outer insulator, and to form a longitudinal direction of gas in said outer insulator, increasing an effect of reflection and refraction of light.

A tubular decoration light string comprises multiple luminaries being connected with multiple electrical conductors in series, parallel or series and parallel.

The said tubular decoration light string comprises the luminaries being vacuum bulbs, bulbs filling with air, LED, or diode.

The said tubular decoration light string has an inner insulator formed by soft plastic to be extruded, in which said inner insulator being able to be transparent, translucent or various colors, the center of said inner insulator predetermined hollow to contact the decoration light string.

The said tubular decoration light string has the luminaries and parts of electrical conductors are arranged and sealed in the predetermined hollow of the inner insulator, and parts of single or multiple conductors are fixed and sealed within the soft plastic insulator.

The said tubular decoration light string has the outer insulator formed by soft plastic to be extruded, in which said outer insulator is able to be transparent, translucent or various colors, the inner insulator and light string is sealed within the outer insulator.

Said tubular decoration light string has multiple longitudinally hollow between the outer insulator and inner insulator, and said cross-section views of hollow can be circular, triangle, square, elliptical or trapezoid Said tubular decoration light string comprises the longitudinal hollow of the outer insulator being able to fill liquid insulator. Said liquid insulator is colorful transparent material.

Said tubular decoration light string also comprises an outer appearance of said outer insulator being convex or concave or wave form.

A tubular decoration light string has the outer appearance of convex or concave or wave form being horizontal, longitudinal or irregular form of the rectangular direction of the tubular light string.

A tubular decoration light string has a cross-section view of inner insulator being circular, elliptical or square, and a cross-section view of outer insulator being circular, elliptical or square.

BRIEF DESCRIPTION OF THE DRAWINGS

FIG. 2 is showing cross-section view of inner insulation and outer insulator of the structure of the present invention; FIG. 2A-1 is showing a cross-section view of inner insulator; FIG. 2A-2 is showing the position of the inner insulator of FIG. 2A-1 within the outer insulator the longitudinal hollow of the outer insulator is circular; FIG. 2B-1 is showing a cross-section view of inner insulator; FIG. 2B-2 is showing the position of the inner insulator of FIG. 2B-1 within the outer insulator the longitudinal hollow of the outer insulator is square; FIG. 2C-1 is showing a cross-section view of inner insulator; FIG. 2C-2 is showing the position of the inner insulator of FIG. 2C-1 within the outer insulator the longitudinal hollow of the outer insulator is triangle; FIG. 2D-1 is showing a cross-section view of inner insulator; FIG. 2D-2 is showing the position of the inner insulator of FIG. 2D-1 within the outer insulator the longitudinal hollow of the outer insulator is trapezoid.

FIG. 3 is another embodiment of cross-section view of inner insulation and outer insulator of the structure of the present invention; FIG. 3A-1 is showing a cross-section view of inner insulator; FIG. 3A-2 is showing the position of the inner insulator of FIG. 3A-1 within the outer insulator the longitudinal hollow of the outer insulator is circular; FIG. 3B-1 is showing a cross-section view of inner insulator; FIG. 3B-2 is showing the position of the inner insulator of FIG. 3B-1 within the outer insulator the longitudinal hollow of the outer insulator is square; FIG. 3C-1 is showing a cross-section view of inner insulator; FIG. 3C-2 is showing the position of the inner insulator of FIG. 3C-1 within the outer insulator the longitudinal hollow of the outer insulator is triangle; FIG. 3D-1 is showing a cross-section view of inner insulator; FIG. 3D-2 is showing the position of the inner insulator of FIG. 3D-1 within the outer insulator and the longitudinal hollow of the outer insulator is trapezoid.

FIG. 5 is showing a cross-section view of inner insulator and outer insulator of a further structure of the present invention.

DESCRIPTION OF PREFERABLE EMBODIMENTS

Figure 1:
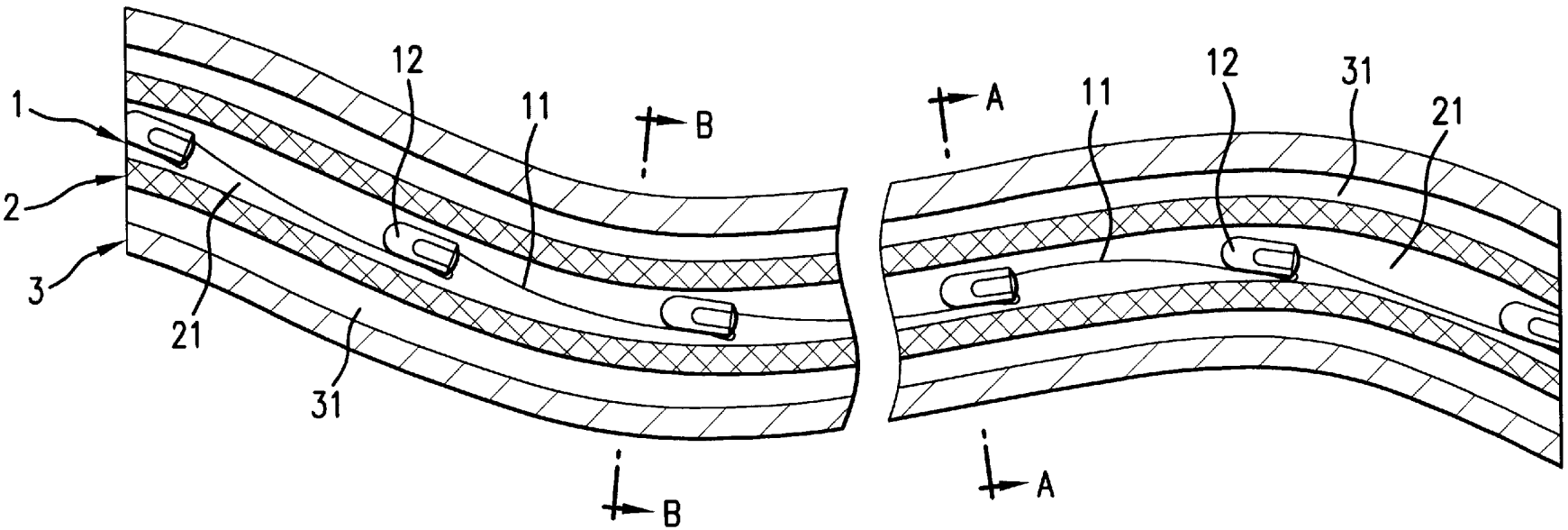
FIG. 1 is a perspective view of a tubular decoration light string of the present invention.

For the explanatory purpose, same reference numbers are used to indicate the same parts of components in the drawings.

Figure 1A:
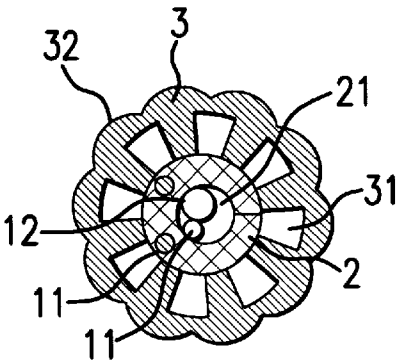
FIG. 1A is showing a cross-section view of FIG. 1 in A—A line.
Figure 1B:
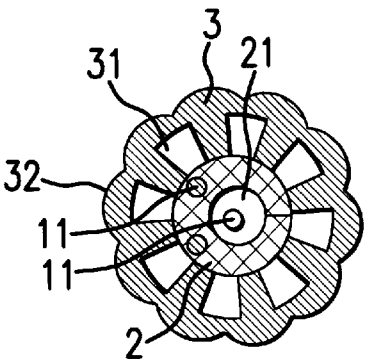
FIG. 1B is showing a cross-section of FIG. 1 in B—B line.

Now referring to FIG. 1, it is a perspective view of a tubular decoration light string of the present invention. Such structure comprises a tubular decoration light string 1 having electrical conductor 11, luminary 12 and inner insulator 2. The inner insulator 2 is formed by soft plastic to be extruded, in which said insulator 2 is able to be transparent, translucent or various colors. The center of said inner insulator 2 has a reserved hollow 21 to contain the tubular decoration light string 1, electrical conductor 11 and luminary 12. The inner insulator 2 and the tubular decoration light string 1 are sealed within an outer insulator 3 to form a longitudinal direction hollow (or body) 31 in said outer insulator 3 so as increase an effect of reflection and refraction of luminary 12. FIG. 1A is showing a cross-section view of FIG. 1 in A—A line, in which the inner insulator 2 and the tubular decoration light string 1 are sealed within an outer insulator 3. The outer insulator 3 has a reversed hollow 31 and is arranged in it. The inner insulator 2 is equipped with single or multiple electrical conductors 11 and the center part has a reserved hollow 21 to equip the tubular decoration light string 1 and luminary 12. The said cross-section view is showing the electrical 11 and luminary 12 to be arranged in the reserved hollow 21. Further, the said luminaries 12 can be vacuum bulbs, bulbs filing with air, LED or diode. FIG. 1B is showing a cross-section of Fig. in B—B line. The structure of FIG. 1B is identical to that of in FIG. 1A. In the cross-section view of FIG. 1B indicates that the electrical conductor 11 is within the reserved hollow 21.

Figures 1, 2A:
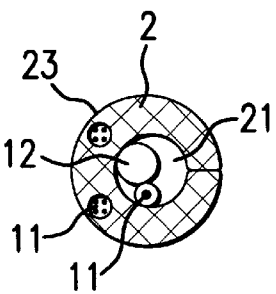
Figures 1, 2B:
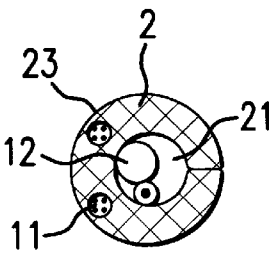
Figures 1, 2C:
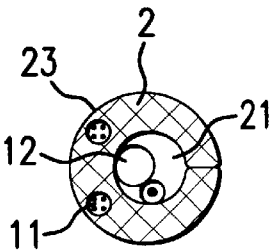
Figures 1, 2D:
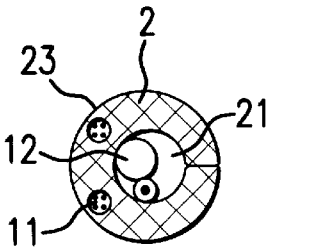
Figures 2, 2A:
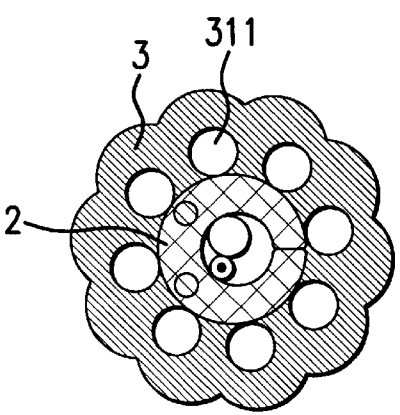
Figures 2, 2B:
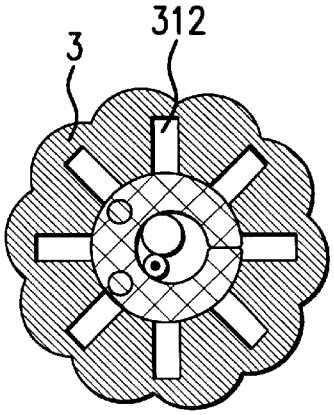
Figures 2, 2C:
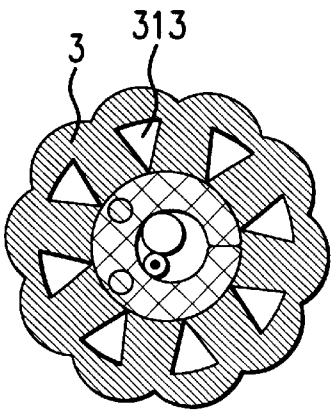
Figures 2, 2D:
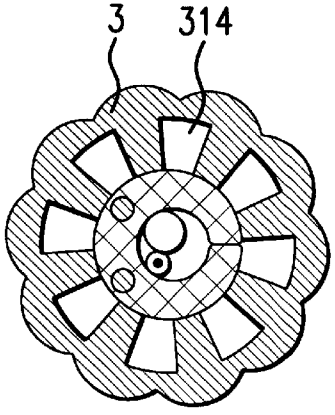
Figures 1, 3A:
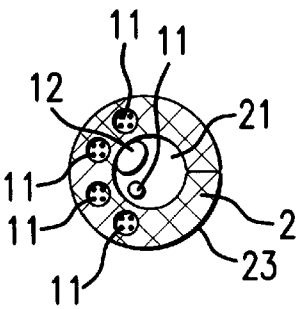
Figures 1, 3B:
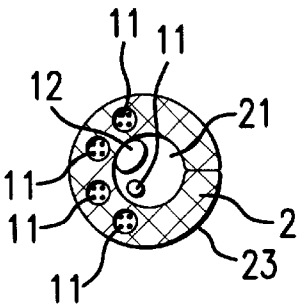
Figures 1, 3C:
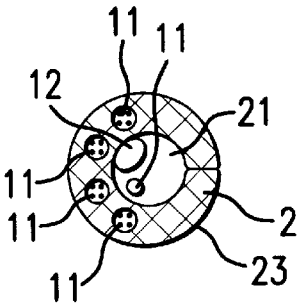
Figures 1, 3D:
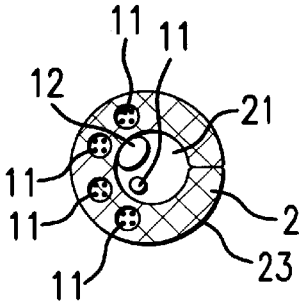
Figures 2, 3A:
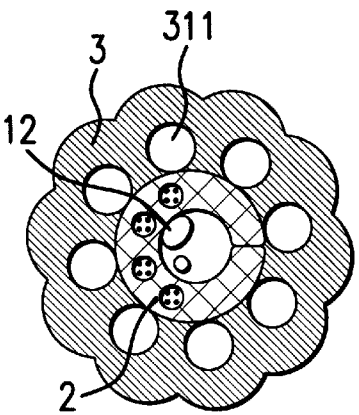
Figures 2, 3B:
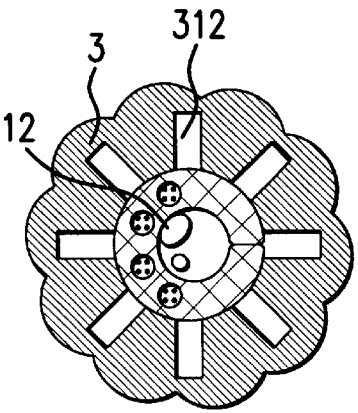
Figures 2, 3C:
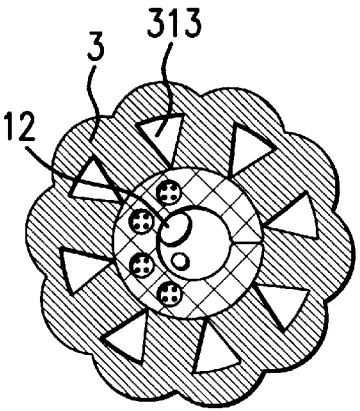
Figures 2, 3D:
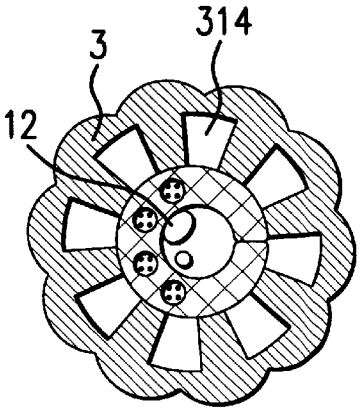

FIG. 2 is showing horizontal cross-section view of the position of the inner insulation 2 and the outer insulator 3 of the structure of the present invention; FIG. 2A-1 is a cross-section view of inner insulator 2 equipped with two electrical conductors 11 and its outer part formed with outer circular cross-section view 23. The inner part has reserved hollow 21, and the electrical conductor 11 and luminary 12 are respectively placed in the reserved hollow. FIG. 2A-2 is the position of the inner insulator 2 of FIG. 2A-1 within the outer insulator 3, and said outer insulator 3 has longitudinal direction hollows with circular or elliptical cross-section view 311. FIG. 2B-1 is a cross-section view of inner insulator 2, in which there two electrical 11 within it, the outside part is to form a circular cross-section 23 and the inner part is reserved hollow 21. The electrical conductor 11 and luminary 12 are respectively placed in the reserved hollow 21. FIG. 2B-2 is a relative position of the inner insulator 2 of FIG. 2B-1 within the outer insulator 3. Said outer insulator 3 has the longitudinal direction hollow with square cross-section view 312. FIG. 2C-1 is a cross-section view of inner insulator 2, in which there are two electrical conductors 11 within it, the outside part is to form a circular cross-section 23 and the inner part is reserved hollow 21. The electrical conductor 11 and luminary 12 are respectively placed in the reserved hollow 21. FIG. 2C-2 is the position of the inner insulator 2 of FIG. 2C-1 within the outer insulator 3. Said outer insulator 3 has the longitudinal direction hollow with triangle cross-section view 313. FIG. 2D-1 is a cross-section view of inner insulator 2, in which there are two electrical conductors 11 within it, the outside part is to form a circular cross-section 23 and the inner part is reserved hollow 21. The electrical conductor 11 and luminary 12 are respectively placed in the reserved hollow 21. FIG. 2D-2 is the position of the inner insulator 2 of FIG. 2D-1 within the outer insulator 3. Said outer insulator 3 has the longitudinal direction hollow with trapezoid cross-section view 314.

FIG. 3 is another embodiment of cross-section view of FIG. 2 is showing cross-section view of inner insulation and enter insulator of the structure of the present invention. FIG. 3A-1 is a cross-section view of inner insulator 2 equipped with two electrical conductors 11 and its outer part formed with outer circular cross-section view 23. The inner part has reserved hollow 21, and the electrical conductor 11 and luminary 12 are respectively placed in the reserved hollow 21. FIG. 3A-2 is the position of the inner insulator 2 of FIG. 3A-1 within the outer insulator 3, and said outer insulator 3 has longitudinal direction hollows with circular or elliptical cross-section view 311. FIG. 3B-1 is a cross-section view of inner insulator 2, in which there two electrical 11 within it, the outside part is to form a circular cross-section 23 and the inner part is reserved hollow 21. The electrical conductor 11 and luminary 12 are respectively placed in the reserved hollow 21. FIG. 3B-2 is a relative position of the inner insulator 2 of FIG. 3B-1 within the outer insulator 3. Said outer insulator 3 has the longitudinal direction hollow with square cross-section view 312. FIG. 3C-1 is a cross-section view of inner insulator 2, in which there are two electrical conductors 11 within it, the outside part is to form a circular cross-section 23 and the inner part is reserved hollow 21. The electrical conductor 11 and luminary 12 are respectively placed in the reserved hollow 21. FIG. 3C-2 is the position of the inner insulator 2 of FIG. 3C-1 within the outer insulator 3. Said outer insulator 3 has the longitudinal direction hollow with triangle cross-section view 313. FIG. 3D-1 is a cross-section view of inner insulator 2, in which there are two electrical conductors 11 within it, the outside part is to form a circular cross-section 23 and the inner part is reserved hollow 21. The electrical conductor 11 and luminary 12 are respectively placed in the reserved hollow 21. FIG. 3D-2 is the position of the inner insulator 2 of FIG. 3D-1 within the outer insulator 3. Said outer insulator 3 has the longitudinal direction hollow with trapezoid cross-section view 314.

Figure 4A:
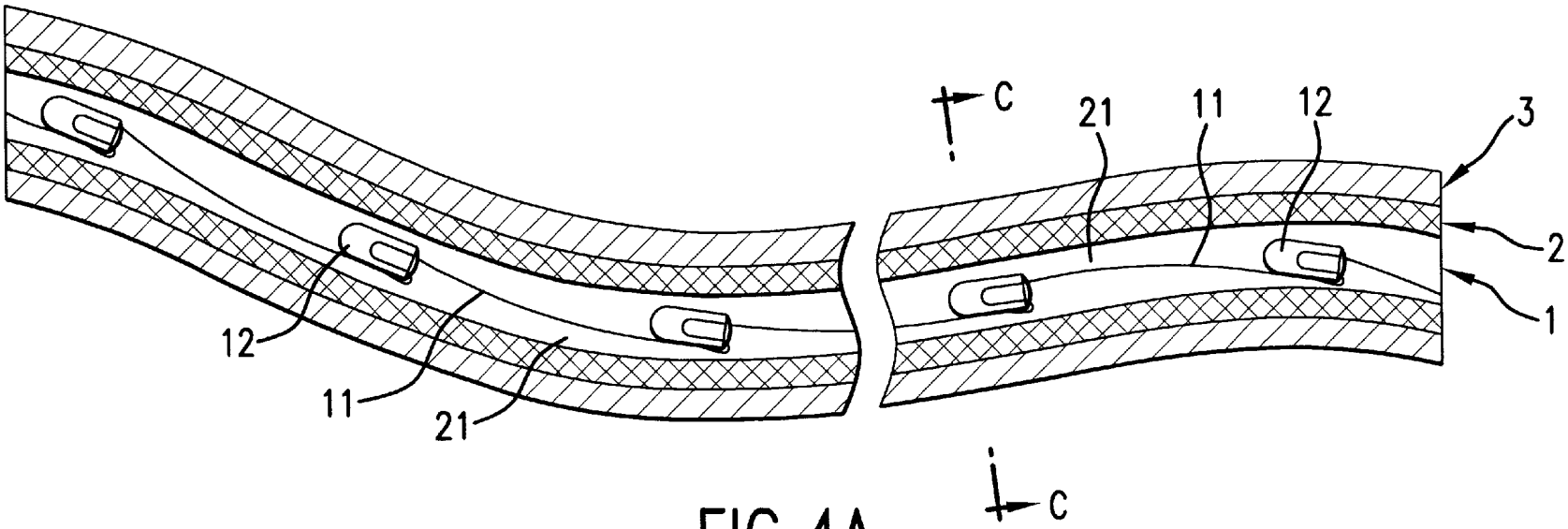
FIG. 4A is showing a cross-section view of FIG. 4 in C—C line.
Figure 4B:
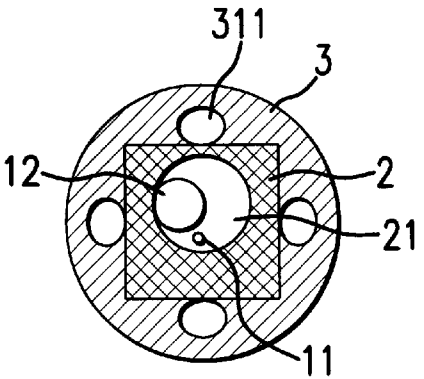
FIG. 4 is a perspective view of a further type of tubular decoration light string of the present invention.

FIG. 4 is a further type of tubular light string of the present invention. Such structure comprises a tubular decoration light string 1 having electrical conductor 11, luminary 12, inner insulator 2 and outer insulator 3. The formation and the formed material of inner insulator and outer insulator are identical with those of in FIG. 1. FIG. 4A is a cross-section view of FIG. 4 in C—C line, in which the inner insulator 2 and tubular decoration light string I are sealed by the outer insulator 3. The outer insulator 3 is also to form a circular longitudinal hollow 311 and the inner insulator 2 is a square cross-section view. The center part has a reserved hollow 21, in which the electrical conductor 11 and luminary 12 of the tubular decoration light string 1 are placed within in it.

Figure 5A:
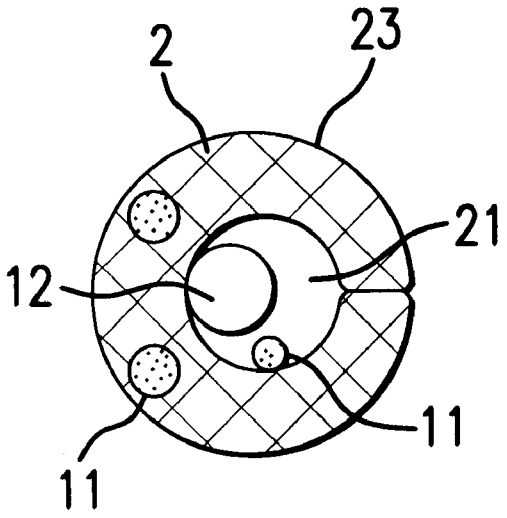
FIG. 5A is a cross-section view of inner insulators.
Figure 5B:
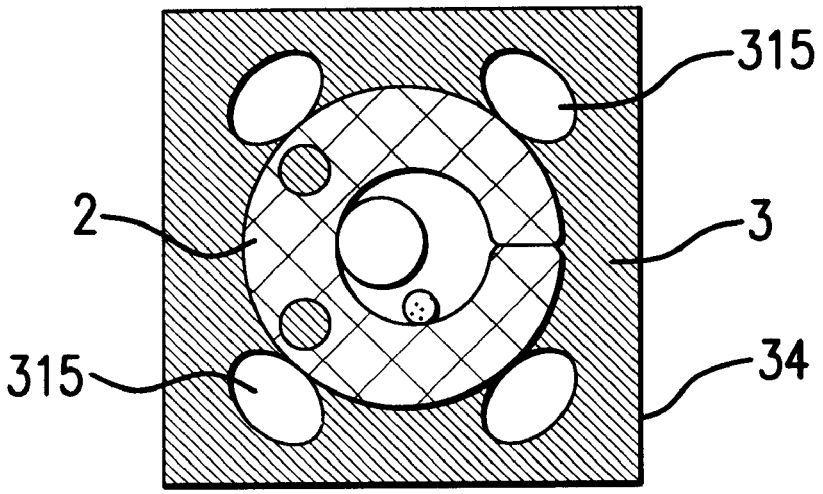
FIG. 5B is the position of the cross-section view of the inner insulator of FIG. 5A within outer insulators.

FIG. 5 is a cross-section view of inner insulator 2 and outer insulator 3 of a further structure of the present invention. FIG. 5A is a cross-section view of inner insulators 2, in which there are two electrical conductors 11 within it, the outside part is to form a circular cross-section 23 and the inner part is reserved hollow 21. The electrical conductor 11 and luminary 12 are respectively placed in the reserved hollow 21. FIG. 5B is the position of the inner insulator 2 within the outer insulator 3. Said outer insulator 3 with square cross-section has the longitudinal direction hollow with elliptical cross-section view 315.

The outer part of the outer insulator 3 is able to be outward wave, outer circular, outer square 34, elliptical or convex or concave form.

The inner insulator 2 is able to be circular 23, square (SEE FIG. 4A), or ellipitical form.

The center part of the inner insulator 2 and outer insulator 3 is longitudinal direction hollow 31, in which the cross-section of said hollow is to form circular cross-section view 311, square cross-section view 312, triangle cross-section view 313, trapezoid cross-section view 314 or elliptical cross-section view 315.

The longitudinal direction hollow 31 of the outer insulator 3 is able to fill liquid insulator, such as transparent material with color.

The features and preferred embodiments of the present invention have been described in the foregoing specification. The invention intended to be protected herein, however, is not to be construed as limited to the particular forms disclosed. Variations and changes, which maybe made by those skilled in the art, are with out departing form the scope of the present invention.

Symbol Lists

1 tubular decoration light string

11 electrical conductor

12 luminary luminaries

2 inner insulator

21 reserved hollow

22 insulating plastic

23 outer circular cross-section view

24 outer square cross-section view

3 outer insulator

31 longitudinal direction hollow (or body)

311 circular cross-section view

312 square cross-section view

313 triangle cross-section view

314 trapezoid cross-section view

315 elliptical cross-section view

32 outward wave

33 outer circular

34 outer square cross-section view

What I claimed is:

1. A tubular decoration light string, comprising an inner insulator, an outer insulator and a light string, said light string being fixed within said inner insulator, said light string and inner insulator being sealed within said outer insulator, a hollow formed in said outer insulator extending in the longitudinal direction, said hollow being filled with a liquid insulator so as to increase the effect of reflection and refraction of light effect.

2. The tubular decoration light string as defined in claim 1, wherein said liquid insulator is a colorful transparent material.

3. The tubular decoration light string as defined in claim 1, wherein said light string comprises multiple luminaries connected with at least one electrical conductor in series, parallel or series and parallel.

4. The tubular decoration light string as defined in claim 3, wherein said luminaries are vacuum bulbs, bulbs filled with air, LED, or diode.

5. The tubular decoration light string as defined in claim 3, wherein said inner insulator is formed of extruded soft plastic material having a longitudinal central hollow formed therein, said inner insulator being transparent, translucent or in color, said light string being contained within said central hollow of said inner insulator.

6. The tubular decoration light string as defined in claim 5, wherein said luminaries and at least part of said at least one electrical conductor are arranged in said central hollow of said inner insulator and at least part of said at least one electrical conductor is fixed and sealed within the soft plastic material of said inner insulator.

7. The tubular decoration light string as defined in claim 1, wherein said outer insulator is formed of extruded soft plastic material which is transparent, translucent or in color.

8. The tubular decoration light string as defined in claim 1, wherein multiple hollows are formed in said outer insulator extending in the longitudinal direction having circular, triangular, square, elliptical or trapezoidal cross section.

9. The tubular decoration light string as defined in claim 1, wherein said inner insulator has a circular, elliptical or square cross section.

10. The tubular decoration light string as defined in claim 1, wherein said outer insulator has a circular, elliptical or square cross section.

* * * * *